US007814820B2

(12) United States Patent
Menefee

(10) Patent No.: US 7,814,820 B2
(45) Date of Patent: Oct. 19, 2010

(54) METHOD AND APPARATUS FOR MANUFACTURING WAD-LESS AMMUNITION

(76) Inventor: Jay Menefee, 355 Riverdale Rd., Macon, GA (US) 31204

( * ) Notice: Subject to any disclaimer, the term of this patent is extended or adjusted under 35 U.S.C. 154(b) by 212 days.

(21) Appl. No.: 11/281,755

(22) Filed: Nov. 17, 2005

(65) Prior Publication Data

US 2007/0107588 A1 May 17, 2007

(51) Int. Cl.
*F42B 33/02* (2006.01)

(52) U.S. Cl. ..... 86/29; 102/455

(58) Field of Classification Search ..... 102/448–463; 86/29

See application file for complete search history.

(56) References Cited

U.S. PATENT DOCUMENTS

| | | | | | |
|---|---|---|---|---|---|
| 458,679 | A | | 9/1891 | Beardsley et al. | |
| 487,028 | A | | 11/1892 | Ginalsky | |
| 1,153,860 | A | | 9/1915 | Butler | |
| 1,853,559 | A | | 4/1932 | Halpin et al. | |
| 2,343,818 | A | | 3/1944 | Sweeley | |
| 2,767,656 | A | | 10/1956 | Zeamer | |
| 3,055,302 | A | | 9/1962 | Bayard et al. | |
| 3,092,026 | A | * | 6/1963 | Williams et al. | 102/455 |
| 3,113,483 | A | | 12/1963 | Puth | |
| 3,195,461 | A | * | 7/1965 | Freed | 102/457 |
| 3,491,690 | A | * | 1/1970 | Knight | 102/448 |
| 3,599,568 | A | * | 8/1971 | Shellnutt et al. | 102/455 |
| 3,721,197 | A | * | 3/1973 | Hughes et al. | 102/451 |
| 3,877,381 | A | | 4/1975 | McCoy | |
| 3,952,659 | A | | 4/1976 | Sistino | |
| 3,996,865 | A | | 12/1976 | Dwyer | |
| 4,162,645 | A | | 7/1979 | Abbott | |
| 4,173,930 | A | | 11/1979 | Faires, Jr. | |
| 4,991,512 | A | | 2/1991 | Van Wyk | |
| 5,864,086 | A | | 1/1999 | Ettmuller | |

* cited by examiner

*Primary Examiner*—Troy Chambers

(57) ABSTRACT

A wad-less shotshell ammunition cartridge may, if desired, have the hull inserted into a cup shaped metal head bottom portion. The hull is pressed into the cup shaped metal bottom portion. The primer is inserted into the center of cup. A measured amount of appropriate propellant is poured into the open end of hull. The measured amount of propellant. An amount of granulated obturating medium is poured into the open end of hull over the propellant. A selectively measured amount of spherically shaped projectiles are poured into the hull. A solid projectile is substituted for the spherically shaped projectiles. A packing tool presses the air out of the mixture of granulated obturating medium, spherically shaped projectiles and propellant. The air is pressed out of the mixture then the projectile is packed into the hull. The packing tool is removed and the open end of hull is reverse rolled and sealed.

5 Claims, 5 Drawing Sheets

METHOD AND APPARATUS FOR MANUFACTURING WAD-LESS AMMUNITION

BACKGROUND OF THE INVENTION

Usually, firearm shotshell ammunition is manufactured by inserting an ignition primer into a cartridge. A measured or selected amount of propellant is inserted or poured into the cartridge. The propellant has a portion thereof contiguous with the primer. A wad, manufactured from a fixed size of material such as cardboard ("nitro card"), cork, plastic and the like, is inserted into the cartridge. One portion of the wadding thereof is contiguous with the propellant.

A projectile, slug or slugs, pellets, spheres, cubes, etc. in any geometric shape may be inserted into the cartridge. The projectile(s) may, if desired, be manufactured from lead, iron or other suitable material, including non-toxic material. The projectile(s) has one portion thereof contiguous with the wadding material. The cartridge is closed by pressure fitting a portion of the cartridge around the projectile(s). The pressure fitting may be accomplished by rolling or folding the cartridge mouth onto the projectile, then crimping the distal edge of the cartridge around the projectile(s). A six or eight point fold or "star" crimp may typically be used in cartridges that contain multiple projectiles ("shot"). An overshot card may be used with a roll crimp to contain shot loads. The loaded ammunition is ready to be packaged with other loaded ammunition.

Typically, ammunition is fired from a firearm by first placing the ammunition into the breach of the firearm. Examples of firearms are rifles, pistols, shotguns, muskets and military type weapons like artillery pieces. In firing the ammunition, a mechanical force is applied against the ignition primer causing an explosion. The resulting action ignites the propellant causing an expanding hot gas to propel the projectile(s) laterally along the bore of the firearm.

Practically, the firing sequence discussed above is ideal and the actual firing sequence includes the burning propellant gases, wadding, and projectile(s), entering a forcing cone before entering the bore of the firearm. The forcing cone is an area between the end of the cartridges in the breach and the bore of the firearm. The large end of the forcing cone is contiguous with the breach and the smaller end is contiguous with the bore. The forcing cone compresses the hot gas and wadding thereby increasing the force present on the projectile (s). If the wadding is not perfectly fitted in the cartridge hull, as well as fitting the chamber throat and forcing cone, the compressed hot gas may not obturate or seal the compressed hot gas. This results in a blow-by effect of the hot gas and possible loss of pressure and projectile speed, or balling of the shot, causing a decrease in the performance of the firearm. If the blow-by effect is sufficient, this may result in obstruction of the bore causing possible damage or rupture of the firearm when firing a second round of ammunition.

It would be desirable to have the full pressure of the compressed gas be developed and contained in the area of the hull, chamber and forcing cone without the blow-by effect. Further, it would be desirable to have a wadding system that does not require the wad to be manufactured or to be perfectly fitted in the cartridge or in the forcing cone.

SUMMARY OF THE INVENTION

The present invention is an improved method and apparatus of manufacturing wad-less shotshell ammunition. Traditionally, ammunition has a solid wad or wads disposed between the projectile and the propellant. The present invention uses a granulated, obturating medium, typically made of suitable polymer, such as polyethylene, disposed between the projectile and the propellant. When the propellant is activated in the chamber of a firearm it burns, creating gases in the chamber and propelling the projectile(s) and obturating medium forward out of the cartridge and throat of the barrel chamber and into the forcing cone. The expanding gases urge the entire ejecta forward, compressing all to the conical shape of the forcing cone and barrel diameter. The obturating medium also compresses to the conical shape of the forcing cone maintaining the gas seal about the end of the projectile (s) in the bore of the firearm. The structural components of the compressed obturating medium press outwardly against the sides of the forcing cone and the sides of the bore creating a load-bearing wall. The obturating medium acts not only as a superior seal, but also insulates the projectile(s) from the intense heat of the powder combustion, and, is unaffected by severely cold temperatures. The obturating medium also provides a cushion effect on the projectile(s) reducing deformation. The end portion of a single projectile receives pressure in urging it forward down the bore of the firearm but does not act as a load-bearing wall for the granulated polymer. If a skirt, or other trailing appendage is present on the projectile, the non-load-bearing function of the present invention does not deform the skirt; thus, it does not distort the aerodynamic performance of the projectile.

When taken in conjunction with the accompanying drawings and the appended claim, features and advantages of the present invention become apparent upon reading the following detailed description of the embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE INVENTION

Figures 1A, 1B:
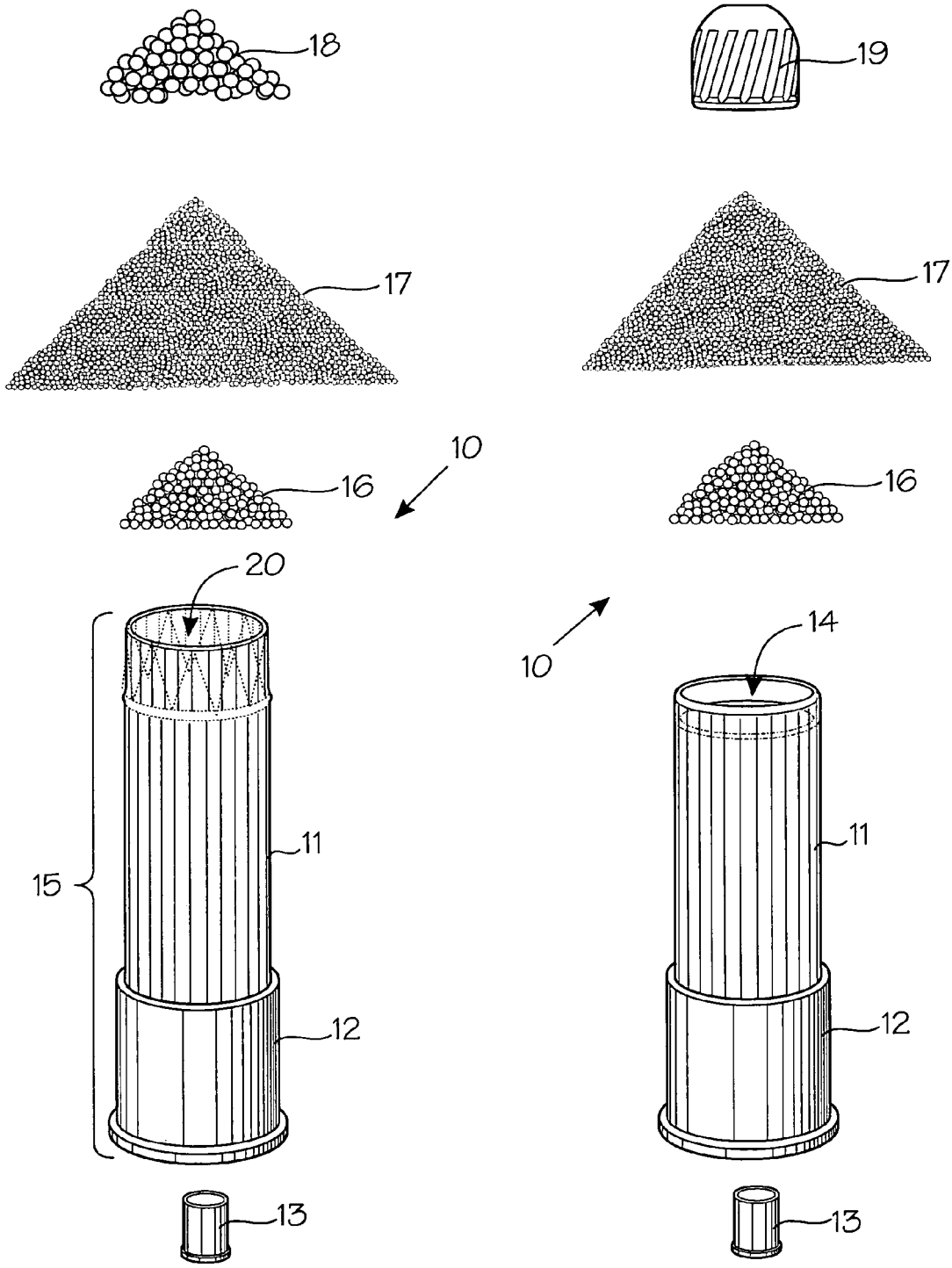
FIG. 1*a* illustrates a top-level schematic view diagram of the preferred embodiment of the present invention with small shot as the projectile.
FIG. 1*b* illustrates a top-level schematic view diagram of the preferred embodiment of the present invention with a solid projectile.

Before describing in detail the particular improved method and apparatus of manufacturing wad-less ammunition in accordance with the present invention, it should be observed that the invention resides primarily in a novel structural combination of conventional components and not in the particular detailed configuration thereof. Accordingly, the structure, control and arrangement of these conventional components have, for the most part, been illustrated in the drawings by readily understandable schematic diagram representations. The drawings show only those specific details that are pertinent to the present invention in order not to obscure the disclosure with structural details which will be readily apparent to those skilled in the art having the benefit of the description herein. For example, a typical wad-less ammunition cartridge 15, FIG. 1*a* has a hull 11, a metal head 12 and a primer 13. Various portions of the interconnection of the hull 11, metal head 12 and the insertion of primer 13 have been simplified in order to emphasize those portions that are most pertinent to the invention. Thus, the schematic diagram illustrations of the Figures do not necessarily represent the mechanical structural arrangement of the exemplary wad-less shotshell ammunition, but are primarily intended to illustrate major structural components of the wad-less shotshell ammunition in a convenient functional grouping whereby the present invention may be more readily understood.

Figure 4:
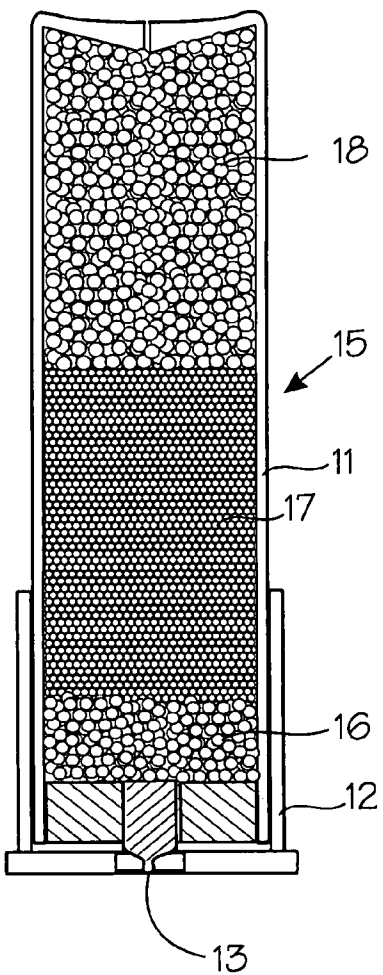
FIG. 4 illustrates a top-level schematic view diagram of the preferred embodiment of the present invention with a star crimped seal.
Figure 6:
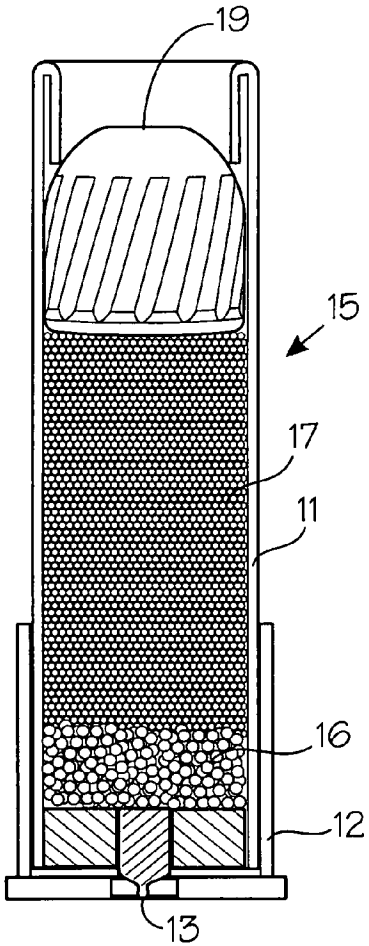
FIG. 6 illustrates a top-level schematic view diagram of the preferred embodiment of the present invention with solid projectile with a roll crimped seal.
Figure 9:
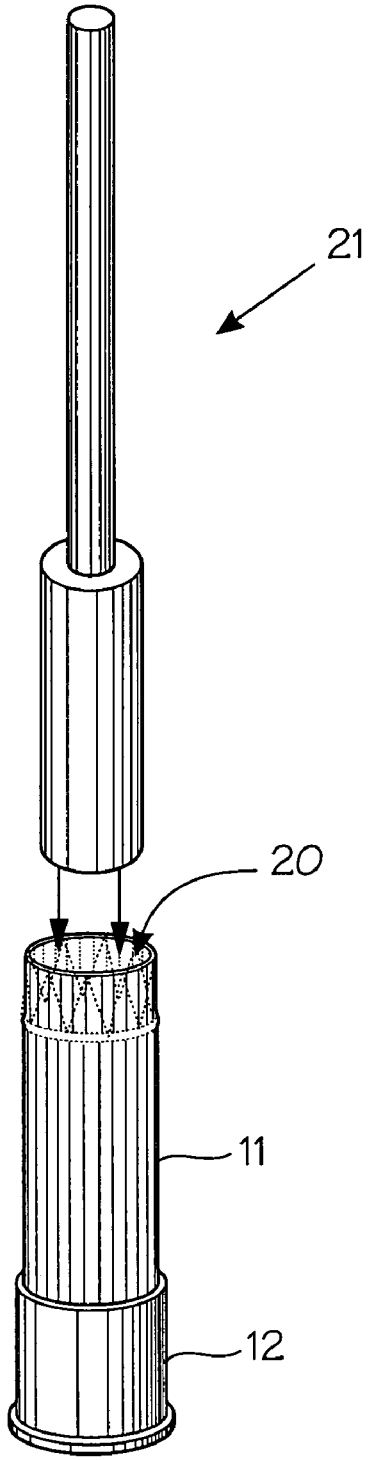
FIG. 9 illustrates a top-level schematic view diagram of a packing tool in concert with loading of a projectile cartridge.

A more detailed discussion of the present invention 10, FIG. 1: The wad-less shotshell ammunition cartridge 15 may, if desired, have the hull 11 inserted into a cup shaped metal head bottom portion 12. The hull 11 may, if desired, be pressed into the cup shaped metal bottom portion 12 or inserted by any convenient means known in the art of making ammunition. The primer 13 provides the initial explosive charge to the cartridge 15 and is inserted into the center of cup 12. A selectively measured amount of appropriate propellant 16 is poured into the open end 20 of hull 11. The measured amount of propellant 16 may vary depending on the type of cartridge 15 that is being loaded. For example, the selected amount of propellant 16 for loading a 12-gauge shotgun hull is more in volume, and has different types of burning characteristics than is required for loading a 410-gauge shotgun hull. A selectively measured amount of granulated obturating medium 17 is poured into the open end 20 of hull 11 over the propellant 16. An example of the granulated obturating medium 17 is finely granulated polyethylene, available from numerous suppliers. Further, a selectively measured amount of spherically shaped projectiles 18 are poured into the open end 20 of hull 11 over the granulated obturating medium 17. A solid projectile 19, FIG. 1*b* may, if desired, be substituted for the spherically shaped projectiles 18, FIG. 1. The measured amount of granulated obturating medium 17, spherically shaped projectiles 18 or the solid projectile 19 may vary depending on the type of cartridge 15 that is being loaded, as discussed above. A packing tool 21, FIG. 9 is inserted into the open end 20 and is urged forward into the hull 11. The packing tool 21 presses the air out of the mixture of granulated obturating medium 17, spherically shaped projectiles 18 and propellant 16. If desired, a two-step packing operation may be performed by inserting the packing tool 21 into hull 11 over the propellant 16 and granulated obturating medium 17. The air is pressed out of the mixture then the projectile or spherically shaped projectiles 18 are packed into the hull 11, more obturating medium is poured into the hull, then re-packed with a packing tool. The packing tool 21 is removed and the open end of hull 11 is reverse rolled and sealed 14 with a typical six point or eight point seal as known in the art. The manufactured cartridge 15, FIG. 4 is complete and sealed with hull 11 press fitted into the cup shaped metal head 12 and primer 13 installed therein. The air has been pressed out of hull 11, granulated obturating medium 17, spherically shaped projectiles 18 or solid projectile 19, FIG. 6 and propellant 16.

Figure 3:
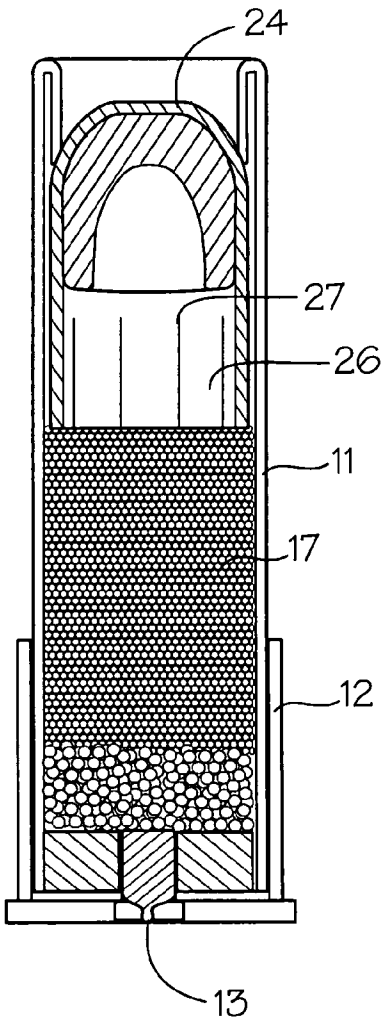
FIG. 3 illustrates a top-level schematic view diagram of the preferred embodiment of the present invention with a solid projectile wherein the projectile has a skirt disposed thereto, using a roll crimp seal.
Figure 2:
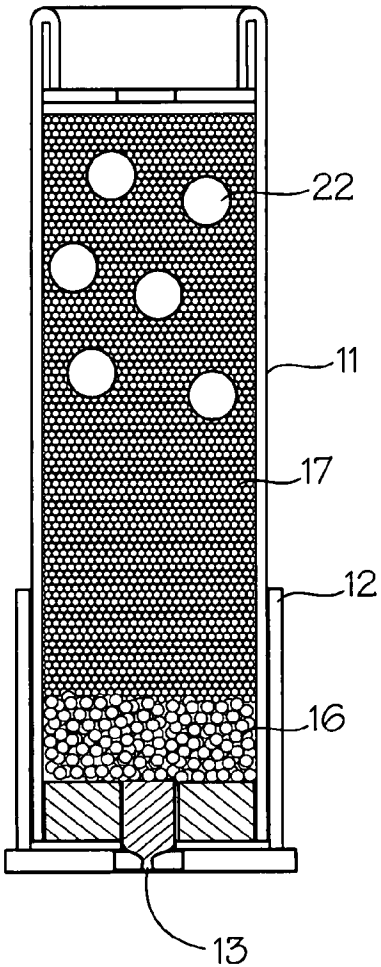
FIG. 2 illustrates a top-level schematic view diagram of the preferred embodiment of the present invention with large shot as the projectile.
Figure 5:
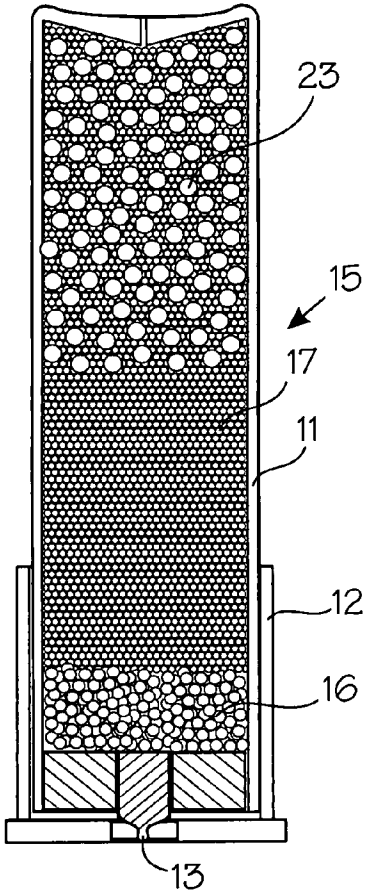
FIG. 5 illustrates a top-level schematic view diagram of the preferred embodiment of the present invention with loosely packed small shot projectile with a star crimped seal.
Figure 8:
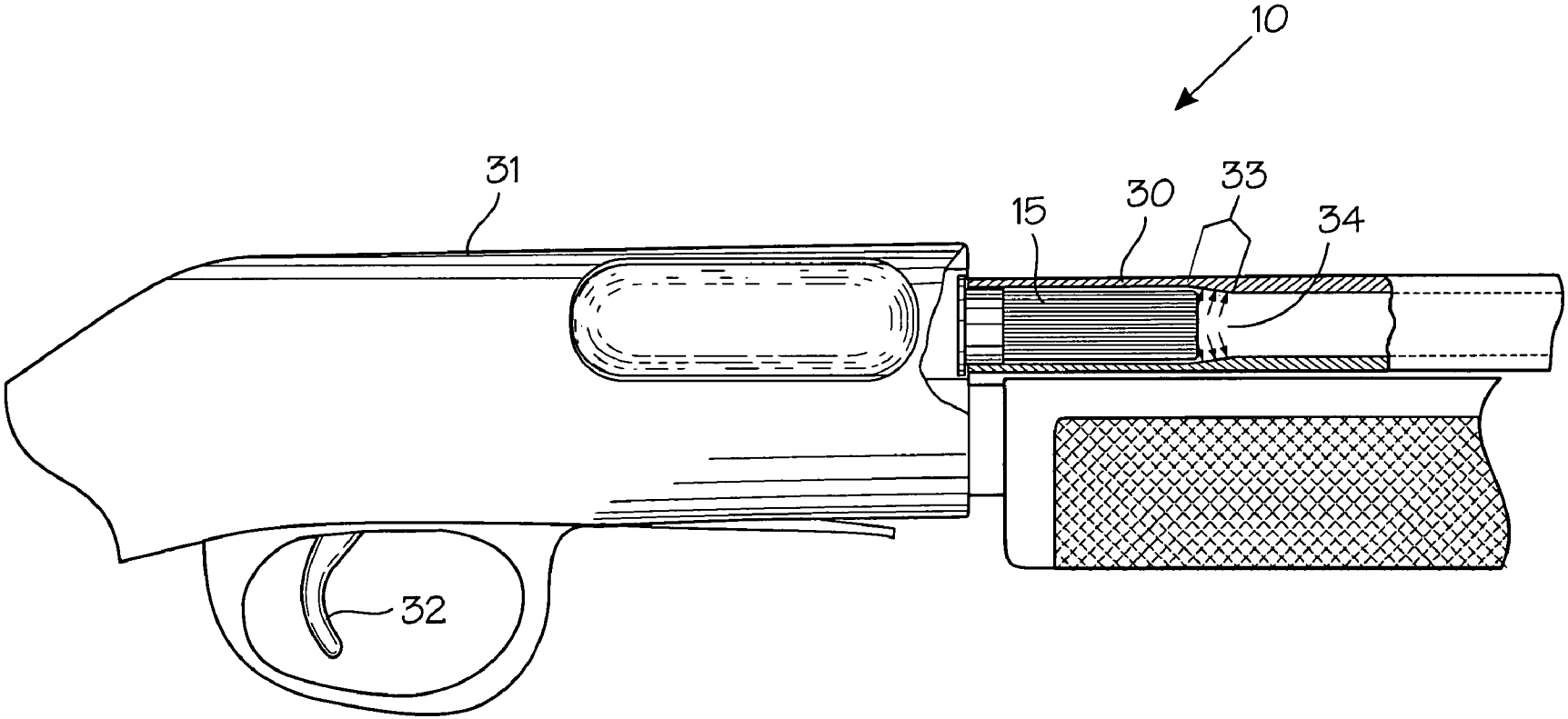
FIG. 8 illustrates a top-level schematic view diagram of a firearm's forcing cone.

Different types of projectiles and loading techniques may, if desired, be used with present invention 10, FIG. 2. Large spherically shaped projectiles 22 FIG. 2 or smaller shaped projectiles 23, FIG. 5 may, if desired, be intermixed with the granulated obturating medium or other "buffer" fillers commonly used with shot in shotshell 17 and loaded into hull 11. A solid projectile with a skirt 24, FIG. 3 may also be used with the present invention 10.

Figure 7A:
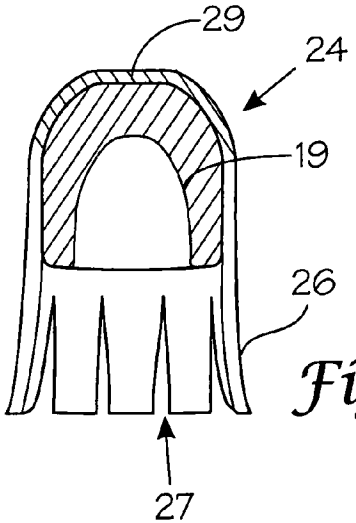
FIG. 7*a* illustrates a top-level schematic view diagram of a solid projectile with a skirt molded thereto wherein said skirt has slits disposed thereto.
Figure 7B:
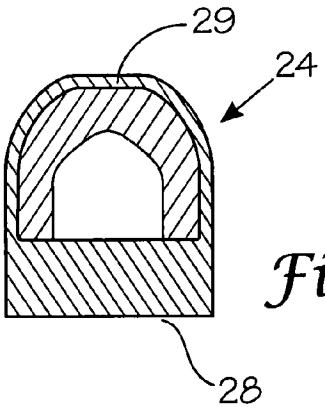
FIG. 7*b* illustrates a top-level schematic view diagram of a solid projectile with a solid skirt molded thereto.

The skirt 24 of the solid projectile 19, FIG. 7*a* may, if desired, surround, enclose or partially enclose the body of the solid projectile 19. The solid projectile 19 is substantially cylindrical in shape with one end 29 rounded. The other end 28 of solid projectile 19 is closed about the rear of the projectile, which may be partially hollow. The solid projectile 19 may, if desired, be manufactured from lead, iron or any other convenient or known material in the art of projectile manufacture. The lower portion 26 of skirt 24 may, if desired, extend below the closed end of the solid projectile 19. The lower portion 26 has a plurality of slits 27, FIG. 3 that are in close proximity to one another when loaded into hull 11. When the solid projectile 19 with skirt 24 attached is fired from a firearm the slits 27, FIG. 7*a* flare outwardly in flight. The skirt 24 may, if desired, be solid about the partially closed area of the projectile. The skirt 24 whether having a solid skirt or a skirt with slits has increased aero-stability in flight. In addition, the skirt 24 shields the projectile from making contact with the bore of the firearm when the cartridge 15 is discharged.

In operation: The cartridge 15 loaded with selected projectile(s), as discussed above, is placed into the chamber 30 of the firearm 31. The user of the firearm 31 engages the trigger 32 wherein the firing-pin strikes the primer 13 causing an explosion and igniting the propellant 16. The propellant 16 burns creating gases in the chamber 30 and propelling the selected projectile(s) and granulated obturating medium 17 forward into a forcing cone 33. The gases compressed to the conical shape of the forcing cone urge the granulated obturating medium 17 and selected projectile(s) forward. The granulated obturating medium 17 also compresses to the conical shape of the forcing cone creating and maintaining a gas seal 34 about the end of the selected projectile(s) in the bore of the firearm 31. The structural components of the compressed granulated obturating medium 17 press outwardly against the sides of the forcing cone and then conform the sides of the bore creating a load-bearing wall. The end portion of the selected projectile(s) receives pressure urging it forward down the bore of the firearm 31 but it does not act as a load-bearing wall for the granulated obturating medium 17. If a skirt, or other trailing appendage 24 is present on the selected projectile(s) the non-load-bearing function of the present invention 10 does not deform the skirt 24 thus not distorting aerodynamic performance of the present invention 10.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claim, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A method of manufacturing wad-less shotshell ammunition comprising the steps of:

a) providing a cartridge with a primer inserted therein;

b) pouring a selected quantity of propellant into said cartridge;

c) pouring a selected quantity of granulated obturating medium over said propellant;

d) compressing said granulated obturating medium onto the said propellant, substantially removing any air, maintaining a seal without a solid sealing wad or gas seal;

e) inserting a projectile over said compressed granulated obturating medium, wherein the granulated obturating medium is disposed between the propellant and the projectile; and f) crimping said cartridge closed; and wherein the ammunition is manufactured with no solid sealing wad or gas seal.

2. A method of manufacturing as recited in claim 1 wherein the step of compressing is inserting a tool into the cartridge and urging said granulated obturating medium onto said propellant.

3. A method of manufacturing as recited in claim 1 further comprising the step of mixing said granulated obturating medium with a plurality of projectiles.

4. A method of manufacturing as recited in claim 1 further comprising the step of providing a continuous skirt for said projectile.

5. A method of manufacturing as recited in claim 1 further comprising the step of providing a sectional skirt for said projectile.

* * * * *